US010220266B1

(12) United States Patent
Wolfe

(10) Patent No.: US 10,220,266 B1
(45) Date of Patent: Mar. 5, 2019

(54) DISC CAPTURE FRAME AND RETRIEVING DEVICE

(71) Applicant: Lavone Wolfe, Huntsville, AL (US)

(72) Inventor: Lavone Wolfe, Huntsville, AL (US)

( * ) Notice: Subject to any disclaimer, the term of this patent is extended or adjusted under 35 U.S.C. 154(b) by 0 days.

(21) Appl. No.: 16/118,644

(22) Filed: Aug. 31, 2018

Related U.S. Application Data

(60) Provisional application No. 62/552,392, filed on Aug. 31, 2017.

(51) Int. Cl.
*B25J 1/02* (2006.01)
*A63B 47/02* (2006.01)
*A63B 67/06* (2006.01)

(52) U.S. Cl.
CPC ..... *A63B 47/02* (2013.01); *A63B 67/06* (2013.01)

(58) Field of Classification Search
CPC ..... A63B 47/02; B25J 47/02
USPC ..... 294/19.2, 99.1, 66.1; 56/328.1
See application file for complete search history.

(56) References Cited

U.S. PATENT DOCUMENTS 2,607,619 A * 8/1952 Butler ..... A47J 45/10 294/33
2,720,411 A * 10/1955 Fletcher ..... H01K 3/32 294/99.1
3,614,149 A * 10/1971 Clark ..... A63B 47/02 15/144.1
4,493,503 A * 1/1985 Jeninga ..... A63B 47/02 294/19.2
5,110,168 A * 5/1992 Petrillo ..... A63B 47/021 294/19.2
5,328,220 A * 7/1994 McPherson ..... A63B 47/02 294/19.2
5,368,350 A * 11/1994 Ader ..... A63B 47/02 294/19.2
5,511,841 A * 4/1996 Allen ..... A63B 47/02 294/19.2
5,823,591 A * 10/1998 Rubinstein ..... A63B 47/02 294/19.2
6,705,654 B2 3/2004 Slauf
6,726,265 B2 4/2004 Miller
7,320,489 B1 1/2008 Domb
7,677,620 B1 3/2010 Tasey
8,657,351 B2 2/2014 Johnson
9,889,345 B2 * 2/2018 Chabot ..... A63B 47/02
2011/0221219 A1 9/2011 Heaton
2015/0015011 A1 1/2015 Silva
2017/0087421 A1 3/2017 Chabot

* cited by examiner

*Primary Examiner* — Paul T Chin
(74) *Attorney, Agent, or Firm* — Patent Grove LLC; Tomas Friend

(57) ABSTRACT

A disc retriever comprising a disc capture frame, a handle, and means for attaching the two to one another provides improvements over prior disc retrievers. A disc capture frame for a disc retriever has a disc capture space bounded on top, bottom, and lateral sides with a gap on the top side that is off center and a hook for hooking, flipping, or repositioning a disc or frisbee. A kit for making a disc retriever comprises a disc capture frame, a handle, and means for connecting the two.

20 Claims, 5 Drawing Sheets

DISC CAPTURE FRAME AND RETRIEVING DEVICE

BACKGROUND OF THE INVENTION

Field of the Invention

The present invention relates to devices that are useful for retrieving disc shaped objects and especially devices useful for retrieving disc golf discs.

Description of Related Art

Disc golf (DG) is a sport in which each player throws a disc at a target using rules similar to those used in golf and is often played on a course of 9 or 18 holes. Players complete a hole by throwing a disc from a tee area toward a target and throwing again from the landing position of the disc until the target is reached. The game is played in at least 40 countries and, in 2016, around 35,600 people were members of the Professional Disc Golf Association (PDGA) worldwide. A golf disc typically has a rim to rim diameter in the range of from 21 cm to 24 cm, with a maximum of 30 cm allowed under PDGA rules. A disc typically weighs between 150 and 180 grams and typically has a height of between 1.6 and 2.0 cm. The rim of a golf disc has a height measured on the inside where the disc is gripped that is less than the disc height and a radial width that is typically in the range of 0.9 cm to 2.5 cm.

PDGA courses have holes that are typically around 300-800 feet long and are built in natural environments to include existing trees, bushes, elevation changes, water hazards and the like to make each hole a unique challenge. As a consequence, discs are often thrown into locations from which it is difficult, unpleasant, or impossible to retrieve them manually. For example, a disc may land in a tree at a position too high to reach by hand. Similarly, a disc may land in or on a bush or in water at a location too far to reach by hand.

The problem of retrieving unfortunately thrown discs has been addressed by a number of inventions. For example, U.S. Pat. No. 6,705,654 describes a folding extension rod having tubular sections with slip-joint connectors that are pulled together by an elastic cord running through the center of the sections and tipped with a tie strap and a hook, magnet, or net for retrieving discs. A disadvantage of this design is that the disc being retrieved must be in a position where it can be hooked or netted. A disc hanging on a hook by its rimmed edge may be caused to fall or be dislodged from the hook by wind, branches, grass, or moving water. A disc in tall grass, caught in branches, or wedged between rocks, for example cannot be netted and may be difficult to hook.

U.S. Pat. No. 6,726,265 describes a disc retriever that can be thrown by a user to a golf disc in a difficult to access location and pulled to the user using an attached cord. The disc retriever has a rectangular wire frame with an opening large enough for a part of a golf disc to enter but not large enough for the disc to slip through the opening. Two pivoting arms can fold into the rectangle frame and pivot forward to form lead arms connected to a long cord used to pull the golf disc through a water hazard with the frame upright. A disadvantage of this design is that a user must be able to accurately throw the retriever to a position from which it can be pulled to the disc. This may be impossible for a disc located in a tree or bush or on terrain with obstacles such as rocks, stumps, and tall grass.

U.S. Pat. No. 7,320,489 describes a golf disc retriever attached to a long handle. The retriever has a spring loaded clip that can be pushed onto an edge of a disc so that the clip grasps the disc on a rimmed edge. Some force must be applied to the spring loaded clip for it to open when contacting the edge of a disc. A disadvantage of this design is that a force must prevent the disc from moving away from the retriever as the clip is opening and a disc floating in water or laying on branches of a tree or bush may be pushed away without being grasped.

U.S. Pat. No. 7,677,620 describes a rake-like disc retriever with a telescopic pole. The retriever has a plurality of tines with teeth that extend downwardly from a plane of the tines in a similar fashion to a rake for raking leaves or cut grass. A disadvantage of this design is that the tines may slip over the disc, especially when the disc is in high grass, mud, or other environment that resists movement.

US 2011/0221219 describes a pneumatic golf disc retriever with a suction cup positioned at the end of an extendable shaft and U.S. Pat. No. 8,657,351 describes a collapsible disc retriever, also with a suction cup. A disadvantage of these designs is that the suction cup requires an adequate seal to the disc so that it may be retrieved. This may be difficult or impossible when a disc is in brush or high grass, mud, or the suction cup cannot be suitably positioned for other reasons.

US 2015/0015011 describes a disc retriever with jaws for grasping a disc on its edge. A disadvantage of this design is a limited ability to move and inability to pull on the disc when it cannot be grasped on an edge from the position where the user stands. A significant disadvantage to this design is that, in order to trigger the jaws, a pushing force must be exerted on the disc. When in water the disc is lighter and it may be pushed out of reach when trying to position the jaws and the force exerted to trip the closing of the jaws may push it away.

US 2017/0087421 describes a disc retriever with an extendable, telescoping pole and a rigid hook. The hook has a flat profile that has a specialized shape to hold various types of golf discs when one of these discs is inserted into an opening of the hook. A disadvantage of this design is that the hook must be properly positioned with respect to the rim of the disc in order for the disc to be held by the hook. This may involve numerous attempts to reposition the disc, depending on the environment from which it being retrieved.

There remains a need for a disc retriever that overcomes the disadvantages of existing disc retrieving devices and that provides for easy, fast, and effective retrieval of discs from a wide variety of locations including tree and bush branches, tall grass, mud, in still and moving water, and crevices between obstructions.

BRIEF SUMMARY OF THE INVENTION

The present invention provides a rigid disc capture frame that provides for easier, faster and effective disc retrieval than existing devices or methods of retrieving discs including golf discs and other flying discs. A person using a disc retriever comprising a disc capture frame and a handle can retrieve a disc more easily, faster and more effectively than a person using existing devices or methods of retrieving discs. Technical features of the invention contributing to improvements over prior disc retrievers include an open capture frame for engaging and capturing the disc and a frame comprising a hook portion for hooking the disc or hooking, flipping, and/or repositioning the disc for subsequent capture.

The capture frame is configured to contain a captured disc on four sides, i.e. top, bottom, and lateral sides, without completely surrounding the disc. A gap in the frame allows the use of a hook portion of the frame to hook onto the rim of a disc, for example to lift a disc hanging in a tree free of branches or other obstructions. This hooking feature allows a user to easily reposition the disc by flipping it by its edge or dragging it to one side by engaging the inside of the disc rim. The gap feature provides an opening in the frame that allows the frame to traverse obstructions as a user pulls the frame toward a disc for retrieval. The dimensions of a capture space contained within the capture frame provide space enough for a disc to enter into and securely engage the capture frame from one side but not to pass through the frame, regardless of orientation.

The frame comprises a means for attachment to a handle and that preferably prevents the frame from rotating with respect to the handle or alternatively moving with respect to the handle. This feature allows the user to control the position of the capture fame relative to obstacles and the disc as the frame approaches the disc and receives the disc into the capture space. The means for attachment is preferably configured so that the handle extends toward a user's handle from the frame at an angle relative to a reference plane in the frame that allows the user to comfortable position the frame at a point distal to a disc, relative to the user, capture the disc in the capture space, and pull the disc toward the user.

BRIEF DESCRIPTION OF THE DRAWINGS

The elements of the drawings are not necessarily to scale relative to each other, with emphasis placed instead upon clearly illustrating the principles of the disclosure. Like reference numerals designate corresponding parts throughout the several views of the drawings in which.

DETAILED DESCRIPTION OF THE INVENTION

All art specific terms used herein are intended to have their art-accepted meanings in the context of the description unless otherwise indicated. All non art specific terms are intended to have their plain language meaning in the context of the description unless otherwise indicated.

As used herein, terms such as "top," "bottom," "above," "below," "lateral," "upward", "downward", "inner", "outer", or the like are used for the purpose of facilitating a description of the invention. These terms are intended as relative terms to describe relative directions about the structure of a frame for retrieving a disc as though the frame being described were observed in a horizontal, upright orientation such as illustrated in the views of the drawings. The frame may be described relative to a conventional coordinate system which is centered on a horizontally oriented disc to be retrieved from a horizontal surface. As applied to a disc otherwise oriented in space (e.g. hanging vertically, angled with edges on surfaces at different elevations, floating in water at any angle), these terms are used as relative to the disc being retrieved rather than a flat horizontal surface.

The terms "front" and "back" are used to refer to a retrieving frame as seen by a user holding a handle connected to the frame.

Figure 1:
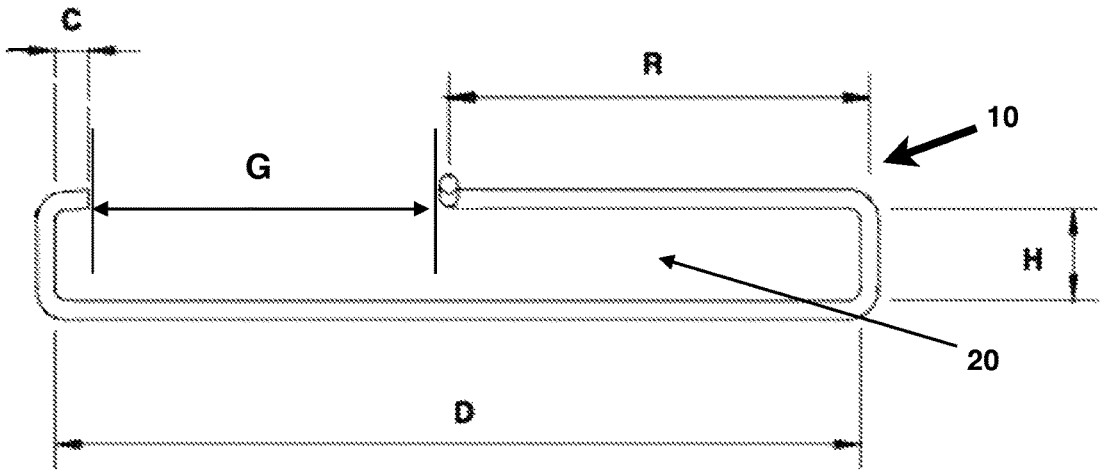
FIG. 1 is a front view of one embodiment of a disc retrieving frame.
Figure 2:
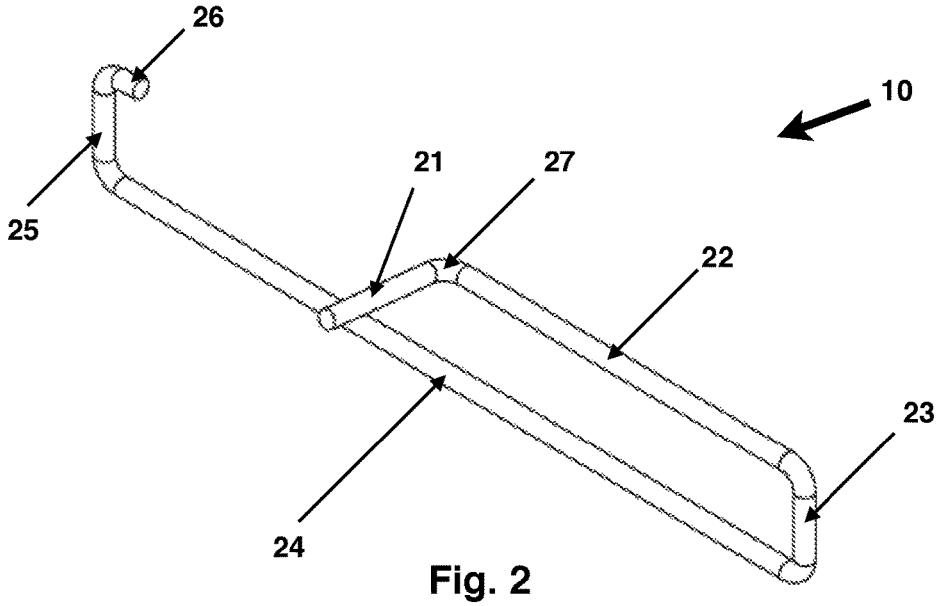
FIG. 2 is a perspective view of a disc retrieving frame.

FIGS. 1-8 illustrate preferred designs of a capture frame (10) and a disc retriever (1) comprising a frame (10) and a handle (61). With reference to FIGS. 1 and 2, a disc capture frame (10) contains a disc capture space (20) having a lateral dimension bounded on left and right sides by left and right portions (25,23) of the frame (10) and having a length D. A lateral dimension with a length D of between 20 cm and 20.9 cm is preferred with a value of 20.8 cm being most preferred for embodiments intended for retrieving golf discs. The lateral dimension may be modified to capture discs of different diameters, according to need. The disc capture space (20) has a vertical dimension bounded on top and bottom sides by top and bottom portions (22,24) of the frame (10) with a height H that is greater than the maximum height of the disc to be retrieved. A vertical dimension H of between 1.3 and 3.5 cm is preferred, with 2.3 cm to 2.4 cm being most preferred for embodiments intended for retrieving golf discs. The combination of lateral and vertical dimensions and shape of the disc capture space (20) allows the frame (10) to engage the disc but should not allow a disc to be captured to pass completely through the disc capture space (20). An opening, or gap, in the frame (10) that is laterally off-center has a gap length or gap distance G and may be present on either the top or the bottom side of the disc capture space (20). In preferred embodiments, the gap length G is between 5.5 cm and 16 cm with a gap length G of 7.5 cm to 7.7 cm being most preferred for embodiments intended for retrieving golf discs. The gap in FIG. 1 is shown as being in the top side of the frame and off center toward the left side but the gap may alternatively be on the right side or in the bottom side of the frame (10) on either the right or the left side. The gap in the frame (10) is flanked on the left and right sides by two frame portions having lengths C and R. In preferred embodiments for capturing golf discs, length C is from 0.75 cm to 1 cm and the length R is between 10.5 cm to 12.0 cm.

Figure 10:
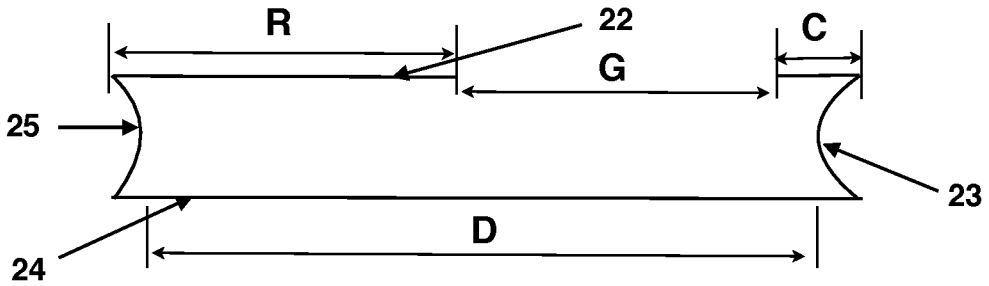
FIG. 10 is a front view of an alternative embodiment of a disc retrieving frame.
Figure 11:
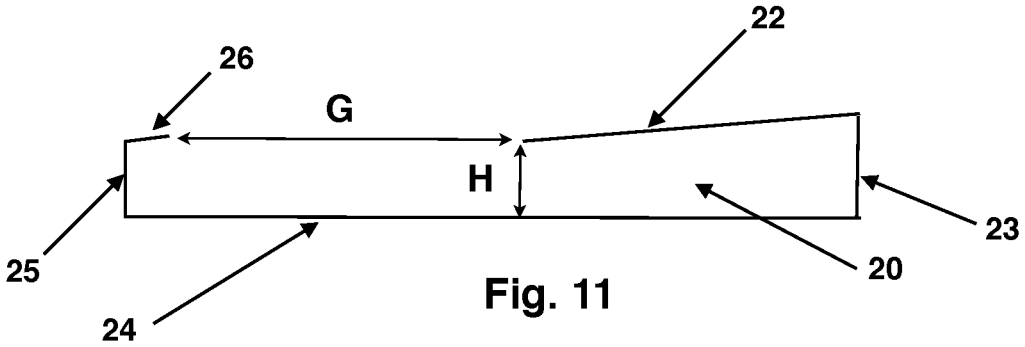
FIG. 11 is a front view of an alternative embodiment of a disc retrieving frame.
Figure 12:
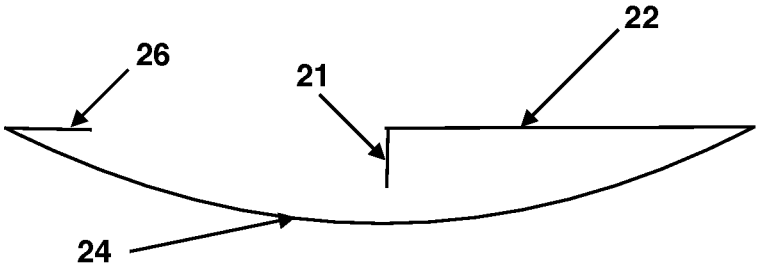
FIG. 12 is a top view of an alternative embodiment of a disc retrieving frame.

The shape of the disc capture space (20) shown in FIG. 1 is an incomplete rectangle when viewed from the front and planar when viewed from the top but other shapes are possible without interfering with the function of the disc capture frame (10). Examples of alternative shapes are shown in FIGS. 10-12. The disc capture space (20) may bounded by a frame (10) made from a single tubular structure that is bent into the desired shape. The tubular structure may be made from any suitable material such as plastic, metal, composite, or bamboo and may have a tubular cross sectional shape that is flat, round, oval, square, rectangular, triangular, or combinations of these. The material comprising the frame may be solid or hollow. In one preferred embodiment, the frame is made from a steel wire having a diameter of between 0.4 cm and 0.5 cm. In another preferred embodiment, the frame is made from polymer or polymer composite material having a diameter of between 0.4 cm and 0.5 cm. The frame structure may be made with flat surfaces facing the disc capture space (20) that are angled so that, in use, the front boundary of the disc capture space closer to the user is slightly larger than the back boundary. The frame (10) need not be made from a single piece but may be made by joining 2 or more separate pieces together. For example, straight pieces of tubing material may be connected by angled pieces to create the desired shape and dimensions. These pieces may reversibly attachable and embodied as a kit of pieces that can be assembled to build the frame (10).

FIG. 2 shows a perspective elevated view of a disc capture frame (10) having the same shape as the frame shown a front view in FIG. 1. The frame (10) comprises a top portion (22) traversing a lateral length R, a right portion (23) traversing a vertical length H, a bottom portion (24) traversing a lateral length D, a left portion (25) traversing a vertical length H, and hook portion (26) traversing a lateral length C. The portions (22-26) are connected by bends or angles (27). The angles shown in FIG. 2 are 90 degree angles and oriented so that the top, right, bottom, left, and hook portions (22-26) form a frame (10) that is essentially planar. As with the frame (10) shown in FIG. 1, the frame (10) may be made by bending a single piece into the shape shown or the frame may be made by connecting two or more pieces together.

Figure 3:
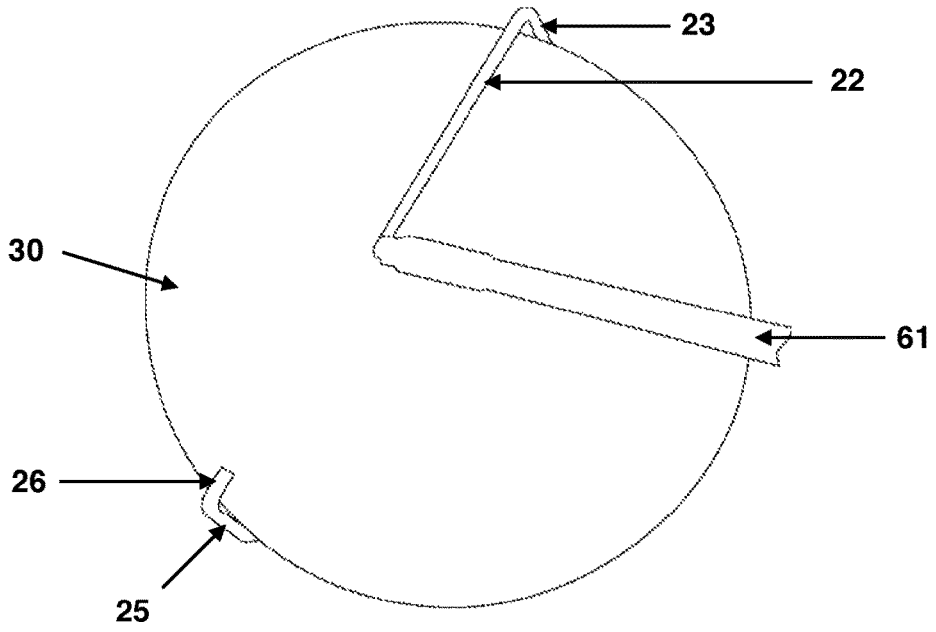
FIG. 3 is a top perspective view of a disc engaged in a disc capture space.
Figure 4:
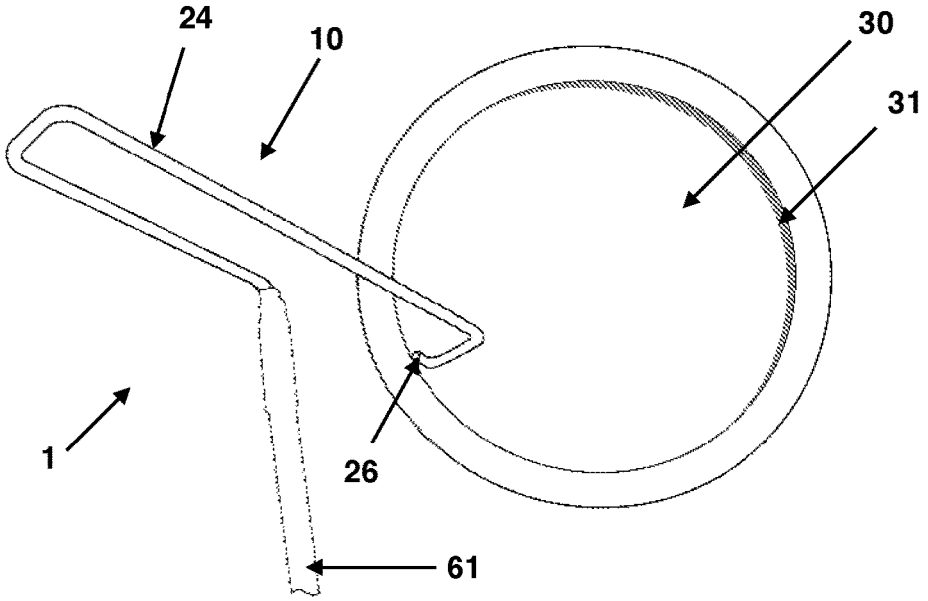
FIG. 4 is a bottom perspective view of a disc hooked on a disc capture frame.
Figure 5:
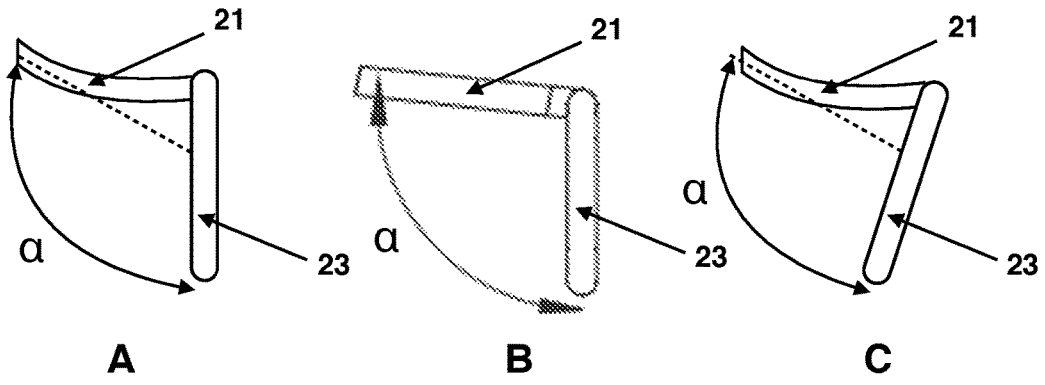
FIG. 5A-C are side views of three embodiments of a disc retrieving frame.

FIGS. 3 and 4 illustrate functional advantages of technical features of a disc retriever (1) comprising a disc capture frame (10) according to the invention. FIG. 3 shows a disc (30) engaged and captured by the disc capture frame of a disc retriever. The hook portion (26) and top portion (22) are visible on the top side of the disc (30) and the right and left portions (25,23) are visible containing the disc (30) in the frame on lateral sides along the edge of the disc. The disc (30) is securely held in place as a user pulls the disc closer using handle (61). FIG. 4 shows an example of how a combination of a gap with a hook portion (26) results in the ability to hook a disc (30) by the inside of the rim (31) to reposition the disc (30) away from obstructions for retrieval as shown in FIG. 3 or by picking up the disc (30) and pulling it toward the user while it is hanging on the hook portion.

Figure 7:
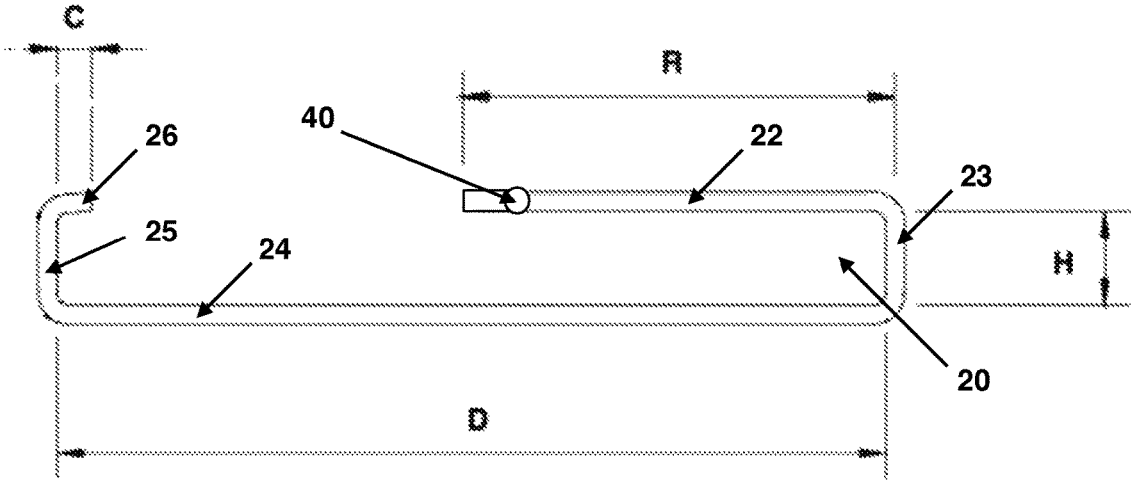
FIG. 7 is a front view of a disc retrieving frame comprising a handle attaching means on the top portion of the frame.
Figure 8:
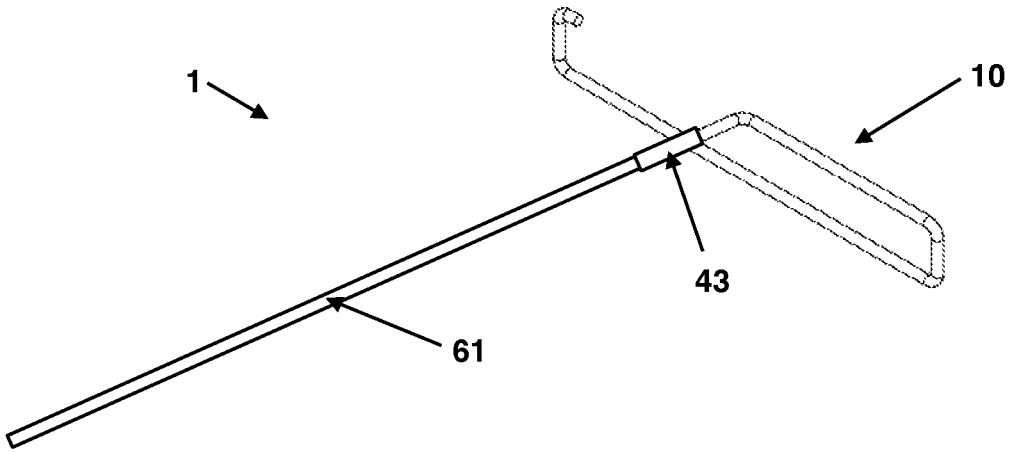
FIG. 8 is a perspective view of a disc retrieving device comprising a disc retrieving frame as shown in FIG. 2.

An attachment portion (21) extends toward the front of the frame (10) and may be used to attach the frame to a handle (61), for example as shown in FIG. 8. An attachment portion (21) is not necessary because a handle may be attached directly to top portion (22) by any of a number of attachment means including clips, screws, hooks, clamps such as quick release, i-bolt, pipe, hose, and ratchet clamps, adhesives, tapes, welds, and combinations of these. The top portion (22) may comprise an attachment structure (40) such as a threaded opening, one or more of a ridge, groove, indent, notch, nick, depression, and combinations of these. FIG. 7 shows such an attachment structure (40) comprising a hole at a preferred location on the top portion of a frame (10) without an attachment portion (21). The attachment structure (40) need not be positioned as illustrated in FIG. 7 and may be positioned anywhere on the frame (10). The attachment structure (40) may comprise a hinged element that can be locked so that the frame (10) may be folded against the handle (61) for storage and locked in place to prevent movement of the frame (10) relative to the handle (61) when in use. In one embodiment, bottom portion (24) of the disc capture frame (10) comprises two overlapping structural elements that allow it to telescope and thereby adjust the lateral length D of the disc capture frame (10).

The attachment portion (21), if present, may be, for example, 1 cm to 6 cm, preferably 3 cm to 5 cm, in length and project axially away from the front side of the frame (10). The attachment portion (21) preferably projects from the top portion of the frame (10) and may alternatively project from the right, bottom, or left portions (23-25) as long as the handle, when attached, does not block a disc from entering the disc capture space (20) and engaging the right and left portions (23,25) of the frame (10). It is preferable that a handle (61) attached to the frame be angled upward to a user so that, when retrieving a disc from the ground, the user can easily position the disc capture frame (10) distally with respect to the disc and pull the disc capture frame (10) toward the disc in an orientation that is optimal for engaging the disc with the disc capture frame (10) in a way that results in capturing the disc. The right-side views of three preferred configurations for the attachment portion (21) relative to a planar frame (10) are shown in FIGS. 5A-C. In these figures the right portion (23) of the frame (10) is visible with the remainder of the frame eclipsed by the right side portion (23). The embodiments shown in FIGS. 5A and 5C each comprise a curved attachment portion (21) that results in an angle $\alpha$, preferably an angle of between 4 and 8 degrees, between the line of a straight handle once it is attached through the attachment portion (21) to the frame (10) and the plane of the frame.

The embodiments shown in FIG. 5A and FIG. 5B are designed for the plane of the disc capture frame (10) to be perpendicular to the disc when engaging the disc, while the embodiment shown in FIG. 5C is designed for the plane of the disc capture frame (10) to be angled so that the bottom side of the disc capture space contacts the disc first when engaging the disc during retrieval. The embodiment shown in FIG. 5B comprises a straight attachment portion (21) projecting forwardly from the plane of the disc capture frame (10) an angle $\alpha$ from the plane of the frame. For such an embodiment, the length of H is still measured vertically with respect to the plane of the disc. In other words, for such an embodiment to have the same H value as an embodiment that is designed to engage the disc at an angle perpendicular to the plane of the disc, the actual distance between the top and bottom sides of the disc capture space must be greater.

Figure 6:
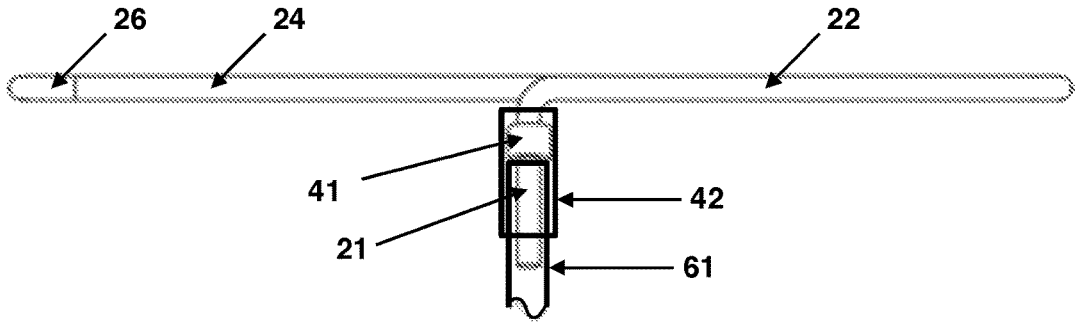
FIG. 6 is a top view of assembled components of a disc retrieving kit comprising a contracting sleeve as part of an attachment means.

The attachment portion (21) may comprise an attachment means (40) for attaching the disc capture frame (10) to a handle (61). Alternatively, a handle may be attached using attachment means such as tape, one or more clamps, screws, nails, adhesive, hooks, welds, or combinations of these. The attachment means may be in the form of a contour or structural element such as a threaded opening or bolt, ridge, groove, indent, notch, nick, depression, or combinations thereof designed to attach to a complementary element on the handle (61). FIG. 6 shows a preferred combination of components for a disc retrieving device kit. The kit comprising a disc capturing frame (10) comprising an attachment portion (21), a handle (61), and a polymeric sleeve (42) that contracts when exposed to heat, for example from a heat gun, match, or lighter. In this example, the handle (61) has a central opening that is larger in diameter than the attachment portion (21) which a portion of the handle slides over. The handle (61) may be any type of handle similar to a handle for a broom, mop, or rake and made of any suitable material such as wood, plastic, metal, composite, or bamboo. The most preferred handle (61) is a straight telescoping handle to provide compact storage. The compression sleeve (42) may be placed so as to overlap both the handle (61) and attachment portion (21) to hold the two pieces together with enough friction to prevent rotation of the frame (10) with respect to the handle (61). The kit may optionally comprise a removable compression nut (41) that is fixed in place on the attachment portion (21) before being covered by the compression sleeve (42) and the handle (61) is slid into place the sleeve heated. Additionally or alternatively, the compression nut (41) may be permanently attached to the attachment portion (21) as an attachment means (40).

An embodiment of a disc capture frame (10) without an attachment portion (21) and having a bottom portion (24) with a length D of between 20.5 cm and 20.9 cm is shown in FIG. 7. An attachment structure (40) is positioned near the end of the top portion (22) toward the center of the disc capture space (20). In this embodiment the length of the right and left portions (23,25) is approximately 10% of the length D of the bottom portion (24). The length C of the hook portion (26) is approximately 5% of the length D of the bottom portion (24). The length of the gap G is approximately 36% the length D of the bottom portion (24) and the length R of the top portion (22) is approximately half the length D of the bottom portion (24). In another embodiment, a frame having these relative dimensions comprises an attachment portion (21) having a length of between 3 cm and 5 cm.

FIG. 8 shows a disc retrieving device comprising a disc capture frame (10) and a handle (61) connected by an attachment means (43). The disc capture frame (10) comprises an attachment portion (21). The attachment means (43) may comprise components on one or more of the handle (61), attachment means (43), and attachment portion (21) and may comprise any connection means described herein such as threaded connections that are screwed together, a compression sleeve (42), a compression nut, a quick release connection, a clamp, adhesive, adhesive tape, and combinations of these.

Figure 9:
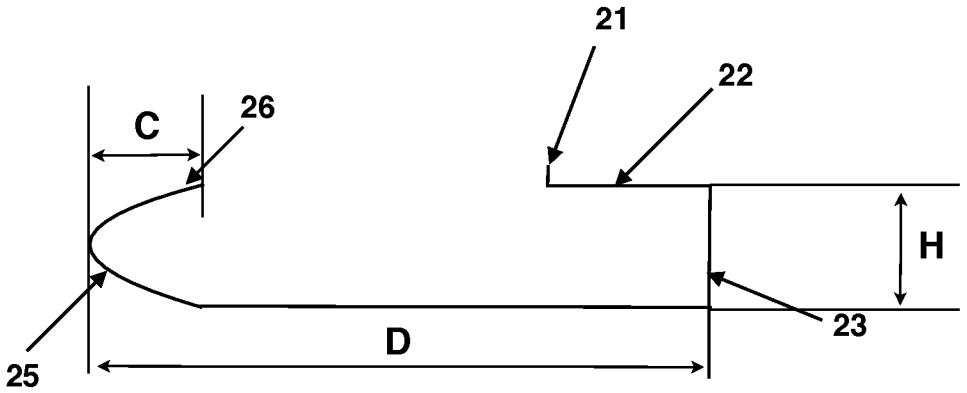
FIG. 9 is a front view of an alternative embodiment of a disc retrieving frame.

A front view of an alternative embodiment of a disc capture frame (10) comprising asymmetric right and left portions (23,25) is shown in FIG. 9. The lateral dimension D of the frame (10) in this case is not the same as the length of the bottom portion (24). because the left portion (25) is angled outwardly from the bottom portion (24). The hook portion (26) is angled inwardly and upwardly in this embodiment. The gap is off center to the left and the top portion (22) is shorter than the top portion (24) in the embodiment shown in FIG. 2.

A front view of an alternative embodiment of a disc capture frame (10) comprising symmetrically curved right and left portions (23,25) and a gap with gap distance G off center toward the right side of the frame (10) is shown in FIG. 10. The hook portion (26) is positioned to the right side of the top portion (22) rather than to the left as with the embodiment shown in FIG. 2. The lateral dimension of the disc capture space (20) is smaller than the length of the bottom portion (24) because of the shape of the left and right portions (25,23).

A front view of an alternative embodiment of a disc capture frame (10) comprising right and left portions (23,25) having different lengths, a top portion (22) angled downward, and a hook portion (26) angled upward is shown in FIG. 11. The vertical dimension H of the disc capture space is smaller than the length of the left portion (23) because the top portion (22) is angled downward.

A top view of an alternative embodiment of a disc capture frame (10) comprising a bottom portion (24) that curves outwardly from the front side of the frame (10) is shown in FIG. 12. This feature may be combined, for example with configurations shown in front view for embodiments shown in FIG. 2, FIG. 9, FIG. 10, or FIG. 11. The embodiments shown in FIGS. 9-12 are a small number of representative examples of alternative functional embodiments of the disc capture frame (10) possible.

The invention claimed is:

1. A disc retrieving frame for retrieving a golf disc, said disc retrieving frame containing a disc capture space, said frame comprising;

a top portion, a right portion, a bottom portion, a left portion, and a hook portion that bound the disc capture space, wherein:

said left and right portions are positioned on opposite sides of the frame and spaced apart by a distance D that is less than a diameter of the golf disc;

said top and bottom portions are positioned on opposite sides of the frame between the left and right portions and spaced apart by a distance H that is greater than a height of the golf disc;

said top portion has a length R that is shorter than distance D;

said hook portion is positioned on the opposite side of the frame from the bottom portion; and said frame comprises a gap having a gap length G between said hook portion and said top portion.

2. The disc retrieving frame of claim 1, wherein the hook portion extends at least partly toward the top portion and the gap distance G is from 0.30 to 0.45 distance D.

3. The disc retrieving frame of claim 1, wherein said distance H is between 8% and 16% of the distance D.

4. The disc retrieving frame of claim 1, wherein the distance R is between 0.35 and 0.5 times the distance D.

5. The disc retrieving frame of claim 1, wherein distance D is between 20 cm and 21.5 cm and distance H is between 2.3 cm and 2.5 cm.

6. The disc retrieving frame of claim 1, wherein the top portion has a length R of 10.87 cm and the hook portion has a length C of 0.87 cm.

7. The disc retrieving frame of claim 1, further comprising a handle attached to the frame.

8. The disc retrieving frame of claim 1, further comprising an attachment means for attaching the frame to a handle.

9. The disc retrieving frame of claim 8, wherein said attachment means, when the handle is attached to the frame, prevents the frame from moving relative to the handle.

10. The disc retrieving frame of claim 8, wherein:

the top, right, bottom, left, and hook portions are tubular portions arranged in a same plane and attachment to the handle results in an angle $\alpha$ between said handle and said plane of the frame; and the attachment means is configured to attach a straight handle to the frame at an obtuse angle with respect to the same plane.

11. A kit comprising the disc retrieving frame of claim 8 and a handle.

12. A disc retrieving frame for retrieving a golf disc, said frame comprising:

a disc capture space having a lateral dimension D that is greater than ½ the diameter of the golf disc but less than 0.95 times the diameter of the golf disc and a vertical dimension H that is greater than a maximum height of the golf disc but less than twice the maximum height of the golf disc, wherein:

said disc capture space is bounded by contact surfaces of contiguous frame elements on top, bottom, and lateral sides and said frame comprises a gap having a gap length G on a top or bottom side such that one of the top and bottom frame elements is discontiguous.

13. The disc retrieving frame of claim 12, wherein the frame comprises a hook portion that extends at least partly along a top side of the frame and the gap distance G is from 0.30 to 0.45 distance D.

14. The disc retrieving frame of claim 12, wherein said distance H is between 8% and 16% of the distance D.

15. The disc retrieving frame of claim 12, wherein distance D is between 20 cm and 21.5 cm and distance H is between 2.3 cm and 2.5 cm.

16. The disc retrieving frame of claim 12, wherein the top side of the frame comprises a top portion having a length R of 10.87 cm and the hook portion has a length C of 0.87 cm.

17. The disc retrieving frame of claim 12, further comprising an attachment means for attaching the frame to a handle.

18. The disc retrieving frame of claim 17, wherein said attachment means, when the handle is attached to the frame, prevents the frame from moving relative to the handle.

19. The disc retrieving frame of claim 12, further comprising a handle attached to said frame.

20. A kit comprising the device of claim 12, a handle, and attachment means for attaching the handle to the frame.

* * * * *